US005532808A

United States Patent [19]

Saito et al.

[11] Patent Number: 5,532,808

[45] Date of Patent: Jul. 2, 1996

[54] ELASTIC FIXING ROLLER FOR ELECTROPHOTOGRAPHIC COPYING MACHINE

[75] Inventors: Shinji Saito, Suntoh-gun; Akihiko Sugizaki, Numazu, both of Japan

[73] Assignee: Nitto Kogyo Co., Ltd., Tokyo, Japan

[21] Appl. No.: 412,484

[22] Filed: Mar. 28, 1995

[30] Foreign Application Priority Data

Sep. 2, 1994 [JP] Japan ..... 6-209653

[51] Int. Cl.[6] ..... G03G 15/20

[52] U.S. Cl. ..... 355/290; 219/216; 492/53

[58] Field of Search ..... 355/290; 118/100–119; 219/216; 492/18, 53, 56; 100/93 RP, 176

[56] References Cited

U.S. PATENT DOCUMENTS 4,317,270 3/1982 Watanbe et al. ..... 492/53 X 4,796,049 1/1989 Taniguchi et al. ..... 219/216

4,949,130 8/1990 Torino ..... 355/290 X 5,130,754 7/1992 Hishikawa ..... 355/282

5,342,277 8/1994 Steiner et al. ..... 492/56

*Primary Examiner*—Joan H. Pendegrass

*Assistant Examiner*—Quana Grainger

*Attorney, Agent, or Firm*—Lowe, Price, LeBlanc & Becker

[57] ABSTRACT

An image fixing elastic roller includes a metal core, a sponge layer provided around the metal core, and a fluoroplastic layer provided around the sponge layer, in which the fluoroplastic layer is formed with a plurality of holes in a predetermined distribution for suppressing paper wrinkles from causing, and further, to improve the performance, the fluoroplastic layer is formed with additional holes for providing a higher distribution density at a central portion thereof than at end portions thereof.

7 Claims, 1 Drawing Sheet

ELASTIC FIXING ROLLER FOR ELECTROPHOTOGRAPHIC COPYING MACHINE

BACKGROUND OF THE INVENTION

1. Field of the Invention

The present invention relates to an elastic roller for fixing electrophotographic images, and more specifically, to an image fixing elastic roller which is used as a pressure roller for uniformly pressing an image support sheet relative to an image fixing heating roller.

2. Description of the Prior Art

In general, fixing devices of conventional electrophotographic copying machines or the like are structured such that a non-fixed toner image transferred onto an image support sheet, such as a paper sheet, is heat-pressed between a non-adhesive heating roller and an elastic pressure roller so as to be melted and fixed thereon.

Conventional toner image fixing devices are generally, formed by providing a heat-resisting elastic layer, such as silicone sponge, around a metal core, and further providing a non-adhesive layer, such as a fluoroplastic, on the outer periphery of the elastic layer to prevent the adhesion of toner to the pressure roller.

Since it is common to operate such a fixing device intermittently, it is desired that the heating roller rapidly increases its surface temperature to start the fixing operation within a short period of time after the fixing device is brought into operation. Similarly, it is also desired that the pressure roller approaches the surface temperature of the heating roller within a short period of time after the fixing device is brought into operation. In view of this, the elastic layer of the pressure roller is generally formed of a sponge layer having a relatively low heat capacity and low heat conductivity.

However, there has been a problem such that it has been difficult to fix high-quality images on a number of paper sheets continuously in accordance with the prior art fixing devices, since paper wrinkles are easily formed with a lapse of operating time after the activation of the fixing device.

SUMMARY OF THE INVENTION

It is, therefore, an object of the present invention to provide an improved image fixing elastic roller capable of preventing the deterioration of image quality by suppressing the generation of paper wrinkles, notwithstanding the continuous fixing of images, thereby providing a large number of high-quality fixed images in a successive manner.

According to a first aspect of the present invention, an image fixing elastic roller comprises a metal core; a sponge layer provided around the metal core; and a fluoroplastic layer provided around the sponge layer, wherein the fluoroplastic layer is provided with a plurality of distributed holes.

According to a second aspect of the present invention, an image fixing elastic roller comprises a metal core; a sponge layer provided around the metal core; and a fluoroplastic layer provided around the sponge layer, wherein the fluoroplastic layer is provided with a plurality of distributed holes, and a distribution density of which is made larger at a central portion of the roller than at end portions thereof.

BRIEF DESCRIPTION OF THE DRAWINGS

The present invention will be more fully understood from the detailed description given hereinbelow and from the accompanying drawings of the preferred embodiments of the present invention, which are given by way of example only, and are not intended to limit the present invention.

DESCRIPTION OF THE PREFERRED EMBODIMENT

Figure 1A:
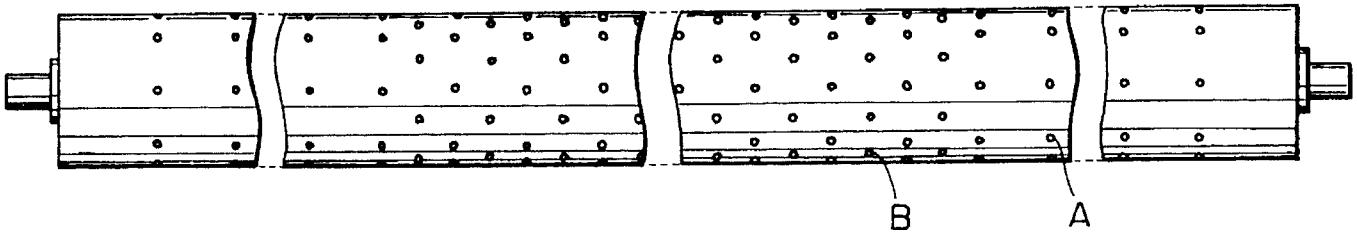
FIG. 1A is a front view of an image fixing elastic roller for illustrating first and second preferred embodiments of the present invention, as compared with a comparative example.
Figure 1B:
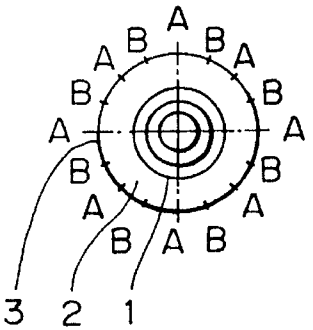
FIG. 1B is a side view of the image fixing elastic roller of FIG. 1A.

Preferred embodiments of the present invention will be described hereinbelow with reference to the accompanying drawings. In FIGS. 1A and 1B, there are shown the front and side views of an image fixing elastic roller for explaining first and second preferred embodiments of the present invention and also a comparative example.

First, the comparative example will be described. Referring to FIG. 1B, an iron core 1 having a diameter of 12 mm was applied with a primer. Thereafter, the primer applied iron core 1 was then coated with a foaming silicone rubber composition by extrusion, and then heated to expand and vulcanized so as to form a foamed silicone rubber sponge layer 2 having 32 degrees of Asker C-type hardness (load =300 g) with an expansion ratio of 170% and a thickness of approximately 6 mm.

Subsequently, the surface of the sponge layer 2 was abraded and applied with a bridged type adhesive, and then was coated with a PFA (perfluoroalkoxyl) plastic tube, which is made adhesive at the inner side and has a thickness of 50μm, and heated for adhesion. Hence, an elastic roller having an outer diameter of 20 mm and a length of 225 mm with fluoroplastic layer 3 at the outermost and an Asker C-type hardness (load =300 g) of 45 degrees was produced.

The first preferred embodiment will be described hereinbelow.

Embodiment 1

The surface of the elastic roller of the sample was pricked with a needle, which has a length of 3 mm and a diameter of 0.6 mm, at an interval of 10 mm with margin of 12.5 mm from both ends of the elastic roller and along 8 straight lines, which are in parallel and 45 degrees apart with respect to a longitudinal center axis of the elastic roller. As a result, an elastic roller of the first preferred embodiment having the fluoroplastic layer 3 provided with 21 holes A aligned on each of 8 straight lines and in total of 168 holes was produced.

The second preferred embodiment will now be described hereinbelow.

Embodiment 2

The surface of the elastic roller of the first embodiment was further pricked with a needle, which has a length of 3 mm and a diameter of 0.6 mm, at an interval of 10 mm with margin of 67.5 mm from both ends of the elastic roller for providing 10 holes per each of 8 additional straight lines inbetween the 8 straight lines of the first embodiment and in total of 80 holes B. As a result, an elastic roller of the second preferred embodiment having the fluoroplastic layer 3 provided with 10 additional holes B aligned on each of 8 additional straight lines and thus arranged are 248 holes (A and B) in total in a zigzag fashion at the central portion thereof for providing a higher distribution density of the holes at a central portion than at end portions thereof.

A test has been carried out with an electrophotograph fixing device by incorporating the fixing elastic rollers of the present invention. By activating the device, electrophotographic copying was successively performed in the following order:

a: copied black solid images on 2 sheets of copying paper of 60 g;

b: copied character images on 30 sheets of copying paper of 60 g; and c: copied black solid images on 2 sheets of copying paper of 60 g.

The copying operation was repeated with respect to 5 rollers for each of the example, first preferred embodiment and second preferred embodiment. Evaluation of the copying was implemented by utilizing the copied black solid images whether or not there were any presence of paper wrinkles, whereas the first sheet of the black solid image copied by step a is designated as a1 and that the second sheet is a2, and the first sheet of the black solid image copied by step c is designated as c1 and that the second sheet is c2. The results of the evaluation are set forth in Table 1. Each figure represents the total points for each of the 5 elastic rollers, wherein 2 points indicate no paper wrinkles, 1 point indicates earthworm-like wrinkles, and 0 points indicate paper wrinkles.

TABLE 1

| elastic roller | a1 | a2 | c1 | c2 |
|---|---|---|---|---|
| comparative example | 10 | 10 | 3 | 3 |
| embodiment 1 | 10 | 10 | 5 | 8 |
| embodiment 2 | 10 | 10 | 10 | 8 |

As apparent from Table 1, the preferred embodiments of the invention, wherein the image fixing elastic rollers are provided with holes, provide considerably improved image quality after repeated copying vis-à-vis the comparative example. This present invention effectively suppresses the formation of paper wrinkles.

Accordingly, in the fixing device incorporating the elastic rollers of the preferred embodiments of the present invention, the stable fixing operation can be performed immediately after the heating roller is warmed to a required temperature, and paper wrinkles are effectively suppressed even upon successive image fixing operations. Further, in accordance with the present invention, the stable fixing operation can be continued reliably for a large number of high-quality images on copying paper.

As further apparent from Table 1, according to the second preferred embodiment, the image fixing elastic roller having concentrated holes A and B at the central portion further improves the image quality after repetition of copying vis-à-vis the comparative example.

It is to be understood that this invention is not to be limited to the preferred embodiments and modifications described above, and that various changes and modifications may be made without departing from the spirit and scope of the invention as defined in the appended claims.

What is claimed is:

1. An image fixing elastic roller comprising:

a metal core;

a sponge layer provided around said metal core; and a fluoroplastic layer provided around said sponge layer and formed with a plurality of holes in a predetermined distribution, wherein a distribution density of said holes of the fluoroplastic layer is larger at the central portion of the roller than at end portions thereof.

2. The image fixing elastic roller as defined in claim 1 wherein a diameter of each hole is substantially 0.6 mm.

3. An image fixing elastic roller comprising:

a metal core;

a sponge layer provided around said metal core; and a fluoroplastic layer provided around said sponge layer and formed with a plurality of holes in a predetermined distribution, wherein the holes are provided along 8 straight lines, which are in parallel and 45 degrees apart with respect to a longitudinal center axis of the elastic roller.

4. The image fixing elastic roller as defined in claim 3, wherein said holes are provided at an interval of 10 mm with margin of 12.5 mm from both ends of the elastic roller along said 8 straight lines.

5. An image fixing elastic roller comprising:

a metal core;

a sponge layer provided around said metal core; and a fluoroplastic layer provided around said sponge layer and formed with a plurality of holes in a predetermined distribution, wherein a distribution density of said holes of the fluoroplastic layer is larger at the central portion of the roller than at end portions thereof, and wherein the first group of holes are provided along 8 straight lines, which are in parallel and 45 degrees apart with respect to a longitudinal center axis of the elastic roller and the second group of holes are provided along 8 additional straight lines in between said 8 straight lines.

6. The image fixing elastic roller as defined in claim 5, wherein said first group of holes are provided at an interval of 10 mm with margin of 12.5 mm from both ends of the elastic roller along said 8 straight lines and the second group of holes are provided at an interval of 10 mm with margin of 67.5 mm from said both ends along said 8 additional straight lines.

7. An image fixing elastic roller comprising:

a metal core;

a sponge layer provided around said metal core; and a fluoroplastic layer provided around said sponge layer and formed with a plurality of holes in a predetermined distribution, wherein a diameter of each hole is substantially 0.6 mm.

* * * * *

UNITED STATES PATENT AND TRADEMARK OFFICE

CERTIFICATE OF CORRECTION

PATENT NO. : 5,532,808

DATED : July 2, 1996

INVENTOR(S) : Shinji SAITO et al.

It is certified that error appears in the above-indentified patent and that said Letters Patent is hereby corrected as shown below:

On the title page, item [75] should read as follows:

--[75] Inventors: Shinji Saito, Suntoh-gun; Akihiko Sugizaki, Numazu-shi; Yuji Uchida, Suntoh-gun, all of Japan--

Signed and Sealed this

Eighth Day of October, 1996

Bruce Lehman

*Attest:*

BRUCE LEHMAN

*Attesting Officer*

*Commissioner of Patents and Trademarks*